United States Patent [19]

McMeans et al.

[11] Patent Number: 5,056,961

[45] Date of Patent: Oct. 15, 1991

[54] METHOD OF CONSTRUCTING WALLS FROM DISCARDED TIRES

[76] Inventors: John D. McMeans; Julia L. R. McMeans, both of 112 Grant Ave., Chesterton, Ind. 46304

[21] Appl. No.: 527,289

[22] Filed: May 23, 1990

[51] Int. Cl.[5] ..... E02D 29/02; E02B 3/12

[52] U.S. Cl. ..... 405/284; 52/DIG. 9; 52/33

[58] Field of Search ..... 52/DIG. 9, 169.1, 33; 428/903.3; 256/24, 73; 405/16, 284, 258, 285

[56] References Cited

U.S. PATENT DOCUMENTS

| | | | |
|---|---|---|---|
| 3,764,446 | 10/1973 | Martin | 52/DIG. 9 |
| 4,188,153 | 2/1980 | Taylor | 405/34 |
| 4,785,577 | 11/1988 | Lederbauer | 52/DIG. 8 |

FOREIGN PATENT DOCUMENTS

| | | | |
|---|---|---|---|
| 2705375 | 6/1978 | Fed. Rep. of Germany | 52/DIG. 9 |
| 372443 | 2/1983 | Fed. Rep. of Germany | 52/DIG. 9 |
| 7714213 | 6/1979 | Netherlands | 52/DIG. 9 |
| 1368772 | 10/1974 | United Kingdom | 52/DIG. 9 |

OTHER PUBLICATIONS

German Patentschrift DD 224 070 A1, 3 pages Dwgs., 2 pages specification.

*Primary Examiner*—James L. Ridgill, Jr.

*Attorney, Agent, or Firm*—Hill, Van Santen, Steadman & Simpson

[57] ABSTRACT

Structural elements formed from a plurality of different sizes in which tires are stacked adjacent to one another, with various surfaces of adjacent tires in contact with one another. The tires are affixed to one another by applying adhesive on respective contact surfaces of adjacent tires, or by using fasteners passing through the tire walls. The tires may be arranged in the form of a maze of a size sufficient to permit humans to pass therethrough. The individual tires forming the structural elements are configured to prevent water from accumulating inside the tires. Water may be prevented from accumulating inside the tires by providing an opening in a side wall of each of the tires. The tires may be stacked in staggering alignment, and may be configured to form a generally arcuate corner. The tires may also be stacked in descending size along ascending height.

10 Claims, 2 Drawing Sheets

FIG. 1
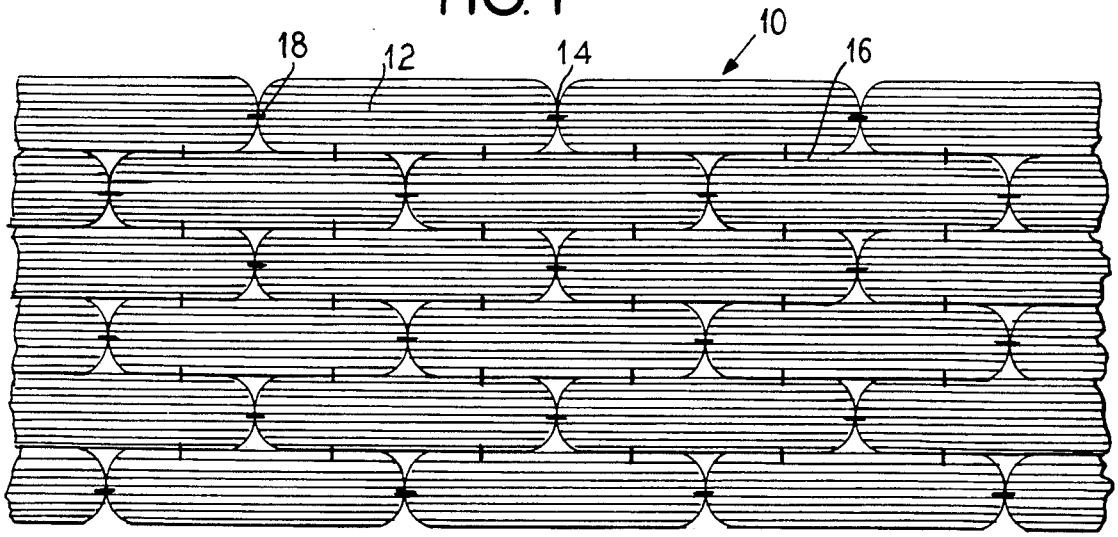
FIG. 2
FIG. 3
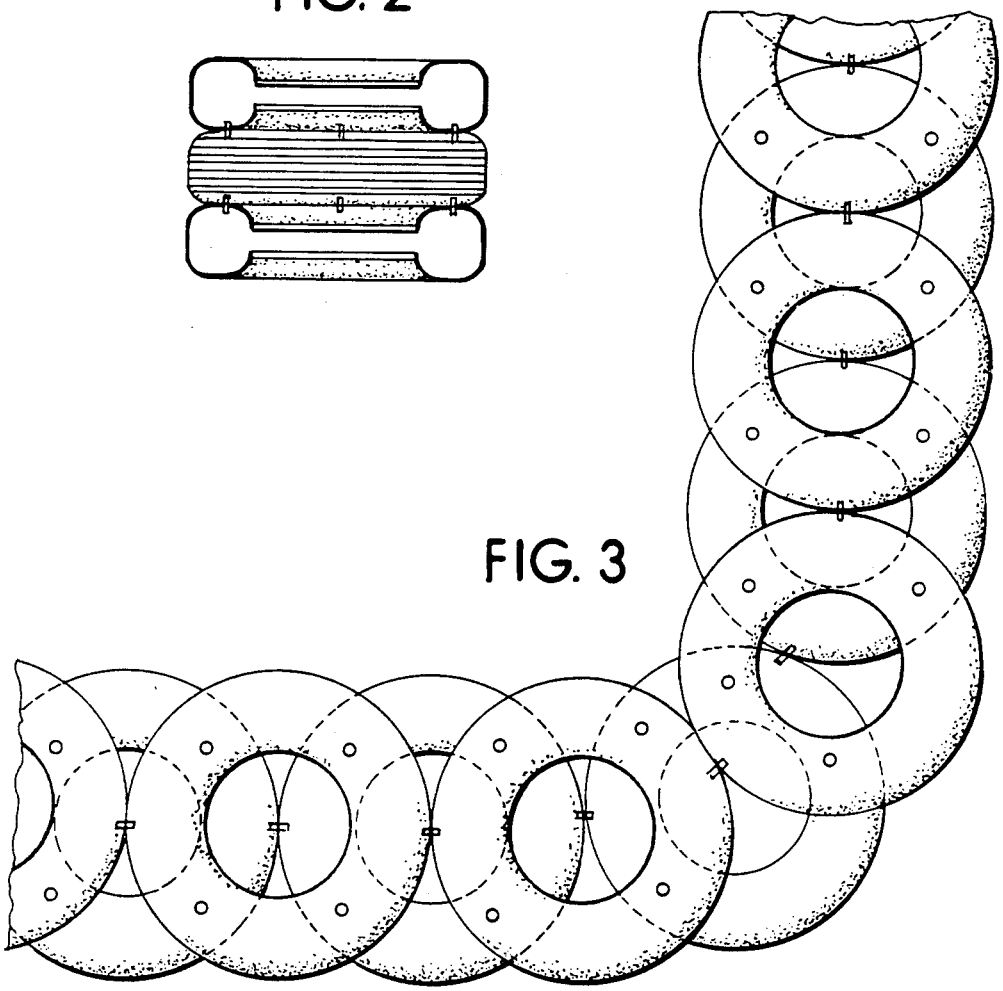

METHOD OF CONSTRUCTING WALLS FROM DISCARDED TIRES

TECHNICAL FIELD

This invention relates to utilizing new or discarded tires of various to create tire blocks usable for many types of construction in an environmentally safe manner.

BACKGROUND OF THE INVENTION

Over the last 100 years various substances have been used to cover and form wheels upon which automobiles could ride. The pursuit of harder and more durable substances for this purpose has culminated in the present synthetic tires which are virtually indestructible. This indestructibility has been a boon to the automobile industry and society in general by creating a reliable and safe wheel usable under adverse conditions such as extreme high speed, friction and cold. Puncture-proofing and steel belting have contributed to the general indestructibility. This boon is creating a solid waste nightmare.

Recently a hugh tire graveyard caught fire and graphically demonstrated how a solid waste problem was quickly converted into an air pollution problem. Whether the old tires are burned, heaped up, or buried, no one knows how long natural deterioration will require. Time has shown that buried tires eventually rise to the surface of landfills thereby puncturing the clay cells. Recently a program of shredding the tires has resulted in less space being taken up by the discarded tires, but no ultimate use has been found to reduce the eventual mounding of shredded rubber.

EPA regulations concerning the disposal of discarded tires provides that they be handled as a solid waste. Many states, such as Indiana, require a license once more than 500 tires are on site.

Another problem of discarded tires has to do the generally less than aesthetic appearance of a pile of discarded tires. Strewn around the country, one can easily observe the use of individual tires as planters of halved tires stood on the cut ends as garden borders. Another common use is as buffer at marinas to keep docking boats from crashing into harder substances. Often individual tire dealers, gas station owners and collectors of junk cars secretly bury used tires, or discard them along lonely stretch of roads or woods. As these tires will for all practical purposes last forever these discarded tires are begining to clutter the landscape and provided a breeding ground for mosquitoes and other water-borne insect larva.

In addition to the long-term environmental problems noted above, discarded tires present immediate economic losses. Operators of businesses where tires are sold, such as service stations and tire dealerships, pay to have discarded tires hauled off to disposal sites. The price for such haulage is calculated on a "per-tire" basis (currently around $2.00/tire), and represents a substantial drain on cash flow for such businesses.

In a separate context, mazes have long been a staple of human amusement and entertainment. Most mazes take the form of parlor games, but "larger-than-life" mazes, built on such a scale as to allow humans to enter and wander through are also known. Due to their size, such mazes are usually erected and constructed out of wood and out-of-doors. Constant exposure of wooden maze walls to the elements greatly accelerates their deterioration, rendering the maze both short-lived and potentially dangerous.

SUMMARY OF THE INVENTION

It is, therefore, an object of the present invention to alleviate the problems associated with discarded tires by using them as structural elements.

These and other objects of the present invention are achieved by the provision of a structural element formed from a plurality of tires of different sizes. The tires are stacked adjacent to one another, with various surfaces of adjacent tires in contact with one another. In a preferred embodiment, the tires are affixed to one another by applying adhesive on respective contact surfaces of adjacent tires. The tires may be arranged in the form of a maze of a size sufficient to permit humans to pass therethrough.

The individual tires forming the structural elements are configured to prevent water from accumulating inside the tires. In one embodiment, water is prevented from accumlating inside the tires by providing an opening in a side wall of each of the tires.

The tires forming the structural elements may be pressure-washed and sealed either before or after formation of the structural element.

In an embodiment, the tires may be stacked in staggering alignment, and may be configured to form a generally arcuate corner. The tires may also be stacked in descending size along ascending height.

Applicants have found that the durability of the discarded tires coupled with the ease with which they can be configured and reconfigured into various patterns make them the perfect tire blocks for a large-scale maze. These very same attributes lend themselves to the use of discarded tires for construction of other outdoor structures. Wind breaking fencing storage sheds, acoustical barriers and garden decorations are all easily achievable. The aesthetics of the structures are easily addressed by painting and growing various vines and flowers in and around the tire blocks. Like discarded railroad ties, discarded tires formed into retaining walls will easily reduce erosion and provide support to landscaping.

Other objects and advantages of the present invention will be apparent upon reference to the accompanying description when taken in conjunction with the following drawings.

BRIEF DESCRIPTION OF THE DRAWINGS

FIG. 1 depicts an elevational view of a fully constructed tire block graphically showing the staggered nature of aligning the tires for stability.

FIG. 2 depicts a sectional view of three tires stacked.

FIG. 3 depicts is a plan view of tire blocks configured around corners.

DESCRIPTION OF THE PREFERRED EMBODIMENT

Figure 4:
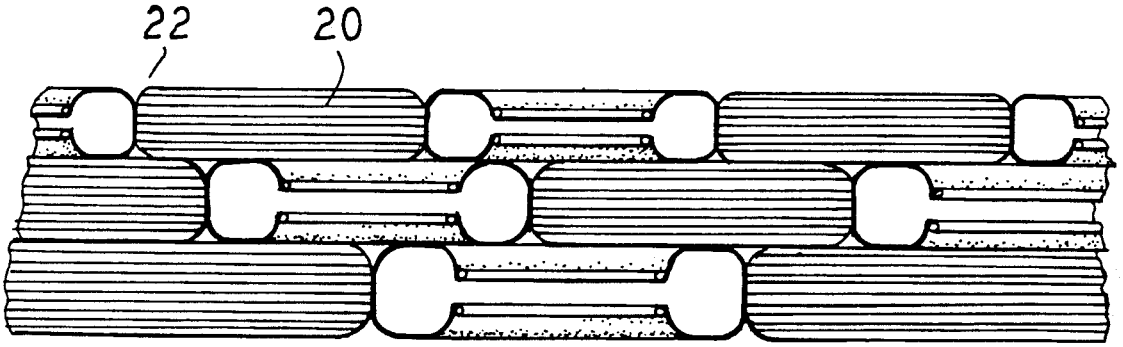
FIG. 4 depicts a cross-sectional view of different sized tires affixed together with adhesive.

As can be seen in FIGS. 1 and 2, a structural element 10 in accordance with the principles of the present invention includes a plurality of tires 12 stacked adjacent to one another. The tires 12 are stacked together with contact surfaces 14, 16 in abutment with one another. In the embodiment shown in FIGS. 1 through 3, the tires are affixed to one another at contact surfaces thereof with a plurality of fasteners 18. The fasteners 18 may be provided as $1\frac{1}{4}$ to $1\frac{1}{2}''$ drywall type screws, which are easily punched through one tire into another. Alternatively, where the anticipated use is a more permanent installation, the fasteners could be provided as screw and bolt combinations.

Since discarded tires are seldom of uniform size, certain structural elements will be configured in which the side walls of the tires are not in alignment, thus making the use of fasteners as previously described impractical. As shown in FIG. 4, a plurality of tires 20 may be affixed together by applying an adhesive layer 22 on respective contact surfaces of adjacent tires. This method may also be employed when a less than permanent use is to be made of a tire block, for example as in a reconfigurable maze. In the FIG. 4 embodiment, the tires are arranged in descending size along ascending heights, such that soil can be placed upon the side walls of the tires to permit the growing of cover vegetation, for example ivy or flowering plants.

Figure 5:
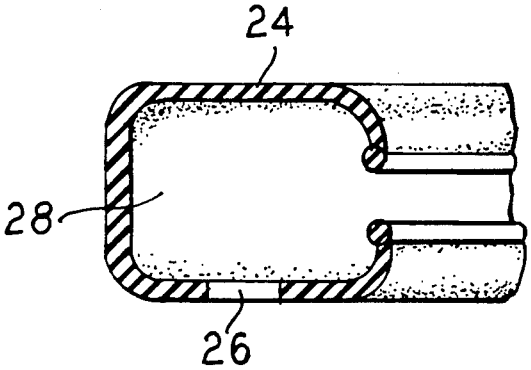
FIG. 5 depicts a sectional view, partially broke away, of one of the tires forming the structural elements of the present invention.

FIG. 5 illustrates a tire 24 forming part of a structural element according to the present invention, in which an opening 26 has been cut into the side wall of the tire in order to prevent the accumulation of water on the interior 28 of the tire. Water accumulation prevention is essential in controlling the development of insect larvae within the individual tires. Alternatively, the tires may filled with dirt, sand, pea gravel, or other natural substances to prevent the accumulation of standing water and to provide a stable barrier against wind, sound, and cold. It is also contemplated that the tops of the tires forming the structural element could be covered to prevent water from entering.

Either before or after assembly of the structural element 10, the tires may be pressure-washed and sealed. Furthermore, various methods may be used to create an aesthetically pleasing appearance of the structural element, such as painting, dryvitting, fiber glassing, or gunniting the exteriors of the tires.

As can be seen from the foregoing description, the present invention provides a method of creating tire blocks primarily usable for outdoor construction and landscaping out of discarded tires. The invention utilizes the natural attributes of the tire to create movable or stable walls for various purposes. A variety of methods are usable for connecting the discarded tires into usable tire blocks.

As shown in FIG. 1, the tires may be stacked in a staggered pattern, thus aligning the tires for stability. In FIG. 2, the tires are shown stacked one on top of another. In FIG. 3, the tire blocks are shown as being stacked in staggering alignment to form a generally arcuate corner. Such corners are especially useful in configuring the tire block into a maze structure, or in landscaping applications. The landscaping barriers made of tires can be useful in erosion control, as acoustical barriers to retard sounds from aircraft, cars, and trains, etc., and as wind barriers.

Although the present invention has been described with reference to a specific embodiment, those of skill in the art will recognize that changes may be made thereto without departing from the scope and spirit of the invention as set forth in the appended claims.

We claim:

1. A method of forming structural elements from discarded tires, said method comprising the following steps:

providing a plurality of tires of different sizes;

stacking said tires adjacent to, and with surfaces in contact with, one another to form a structural element; and affixing said tires to one another by applying adhesive on respective contact surfaces of adjacent tires.

2. A method according to claim 1, further comprising the step of pressure washing said tires.

3. A method according to claim 1, further comprising the step of sealing said tires.

4. A method according to claim 1, wherein said step of stacking said tires comprises stacking said tires in staggering alignment.

5. A method according to claim 1, wherein said step of stacking said tires comprises stacking said tires in staggering alignment to form a generally arcuate corner.

6. A method according to claim 1, wherein said step of stacking said tires comprises stacking said tires in descending size along ascending height.

7. A method according to claim 1, further comprising the step of arranging said tires in the form of a maze.

8. A method according to claim 7, wherein said step of arranging said tires in the form of a maze comprises configuring said maze in a size sufficient to permit humans to pass therethrough.

9. A method according to claim 1, further comprising the step of providing means for preventing water from accumulating inside said tires.

10. A method according to claim 9, wherein said step of providing means for preventing water from accumulating inside said tires comprises providing an opening in a sidewall of each of said tires.

* * * * *